US005438180A

United States Patent [19]

Eisenbrandt et al.

[11] Patent Number: 5,438,180

[45] Date of Patent: Aug. 1, 1995

[54] ELECTRONIC INPUT CONTROL FOR A COOKING OVEN HAVING INDEPENDENT SELECTION OF FUNCTION AND SENTENCE PROGRAMMING

[75] Inventors: Gerald A. Eisenbrandt, Lincoln Township, Berrien County; John R. Bentley, St. Joseph; Thomas B. Bailie, Bridgman; Curtis J. Bailey, Birmingham; Sandra S. Thurlow, Benton Township, Berrien County; Judy K. Heiden, St. Joseph, all of Mich.; James R. Barger, Vandalia, Ohio

[73] Assignee: Whirlpool Corporation, Benton Harbor, Mich.

[21] Appl. No.: 6,806

[22] Filed: Jan. 21, 1993

[51] Int. Cl.[6] ..... H05B 1/02

[52] U.S. Cl. ..... 219/492; 219/506; 219/413; 219/508; 345/146; 345/902

[58] Field of Search ..... 219/508, 506, 497, 492, 219/412, 413; 345/146, 156, 902, 173

[56] References Cited

U.S. PATENT DOCUMENTS

| | | | |
|---|---|---|---|
| 4,158,432 | 6/1979 | van Bavel | 340/309.4 |
| 4,341,197 | 7/1982 | Butts . | |
| 4,454,501 | 6/1984 | Butts . | |
| 4,530,046 | 7/1985 | Munekata et al. | 364/191 |
| 4,725,694 | 2/1988 | Auer et al. | 178/18 |
| 4,918,293 | 4/1990 | McGeorge | 219/492 |
| 4,933,852 | 6/1990 | Lemelson . | |
| 5,285,053 | 2/1994 | Fowler | 219/506 |

FOREIGN PATENT DOCUMENTS 0071725 6/1981 Japan .

OTHER PUBLICATIONS

Whirlpool publication "Use & Care Guide, Self-Cleaning Sealed Burner Gas Range SF385PEW SF386PEW," pp. 13 and 14, 1990.

Roper publication "Electronic Range Controls," pp. 8 and 9, 1988.

*Primary Examiner*—Mark H. Paschall

*Attorney, Agent, or Firm*—Price, Heneveld, Cooper, DeWitt & Litton

[57] ABSTRACT

An electronic control for a cooking oven includes an input selection panel for receiving user input selections and control logic responsive to the input, selection panel for establishing a time and temperature profile of the oven cavity and for controlling heating devices according to the time and temperature heating profile entered by the user. The input selection panel includes heating function selection devices for receiving user selection of a heating function from among a plurality of heating functions and timing function selection devices for receiving user selection of at least one timing function from among a plurality of timing functions. The timing functions are independent of the heating functions so that a user may select any combination of timing functions with any selected heating function. The input selection panel includes labeled selection devices and labeled parameter display devices that define a grammatical sentence. The sentence emulates standard instructions in a cooking recipe. The functions and parameters selected by selection devices are laid out with the parameter display devices in a manner that functions are logically selectable from left-to-right across the panel.

43 Claims, 7 Drawing Sheets

ELECTRONIC INPUT CONTROL FOR A COOKING OVEN HAVING INDEPENDENT SELECTION OF FUNCTION AND SENTENCE PROGRAMMING

BACKGROUND OF THE INVENTION

This invention relates generally to cooking appliances and, more particularly, to cooking ovens, especially those utilizing electronic controls. More particularly, the invention relates to input devices for microcomputer-based oven controls.

Electronic controls, in general, and microcomputer-based controls, in particular, have been applied to various items, including appliances. Electronic controls have many advantages over the electromechanical controls they replace, for example, enhanced reliability and accuracy. The full potential of the electronic control, however, is not often realized. There is a tendency to merely emulate the functions performed by the electromechanical controls that the electronic control is replacing.

A cooking oven is generally capable of performing three functions: broiling food placed under a broiling element, baking food placed in the oven and self-cleaning of the oven by pyrolysis of food residue on the oven walls. Upon selecting a particular heating function, known control may provide the user with the capability of selecting additional subfunctions. For example, a user may be provided with the option of baking a particular food item for a selectable period of time and selecting a delay interval before the baking function is initiated. It is also known to allow the user to select a point in time that the baking interval is to terminate, which would typically coincide with the desired meal time.

Present controls for ovens are not intuitive in operation. For example, without consulting the user's manual, the user may not realize that the bake function must be selected in order to enter a cooking interval and a delay start or stop cooking time. Because the user must often consult the user manual in order to invoke all of the functions of known controls, the known controls are not convenient to the user. The result is that the user does not achieve full enjoyment of the capabilities of the appliance.

SUMMARY OF THE INVENTION

The present invention is intended to provide a clear, concise and intuitive control for a cooking oven, in which the timing functions, such as cook interval, delay start and delay stop, are available to be specified in combination with any of the particular heating functions, such as baking, broiling and cleaning, the user selects for the oven. The present invention is embodied in a cooking oven having means defining an oven cavity and heating means for heating the oven cavity to defined heating temperatures. Control means are provided for receiving user input selections and for establishing a time and temperature heating profile of the oven cavity. The control means includes input selection means for receiving user input selections and logic means responsive to the input means for establishing a time and temperature profile of the oven cavity. The logic means controls the heating means according to the time and temperature heating profile entered by the user.

According to one aspect of the invention, the input means includes heating function selection means for receiving a user selection of a heating function from among a plurality of heating functions and timing function selection means for receiving user selection of at least one timing function from among a plurality of timing functions. The heating functions are substantially independent of the timing functions so that a user may select any combination of timing functions with any selected heating function. The input means may additionally receive user entry of one or more parameters relating to each heating function and timing function selected by the user.

According to another aspect of the invention, the input means includes a user input panel having user input selection means for receiving user input selections of a heating function, heating parameters, at least one timing function and timing parameters. The selection means include labeled selection devices and labeled parameter display devices that define a grammatical sentence. The user input selection means may be physically laid out in a general linear fashion laterally across the face of the panel. In a preferred form, the functions and parameters selected by the selection devices are laid out with the parameter display devices in a manner that functions are logically selectable from left-to-right across the panel. The function and parameter labels may be applied as indicia to the panel. In a preferred form, the heating functions are labeled as grammatical verbs and parameter displays are labeled as grammatical prepositions, so that displayed parameters are grammatical objects of the prepositions. This results in an exceptionally intuitive input selection process, which prompts user inputs without the necessity of reference to a user's manual. In a most preferred form, the sentence programming follows cooking instructions that are traditionally stated in a conventional manner in cooking recipes.

These and other objects, advantages and features of this invention will become apparent from a review of the following specification in conjunction with the drawings.

DESCRIPTION OF THE PREFERRED EMBODIMENT

Figure 1:
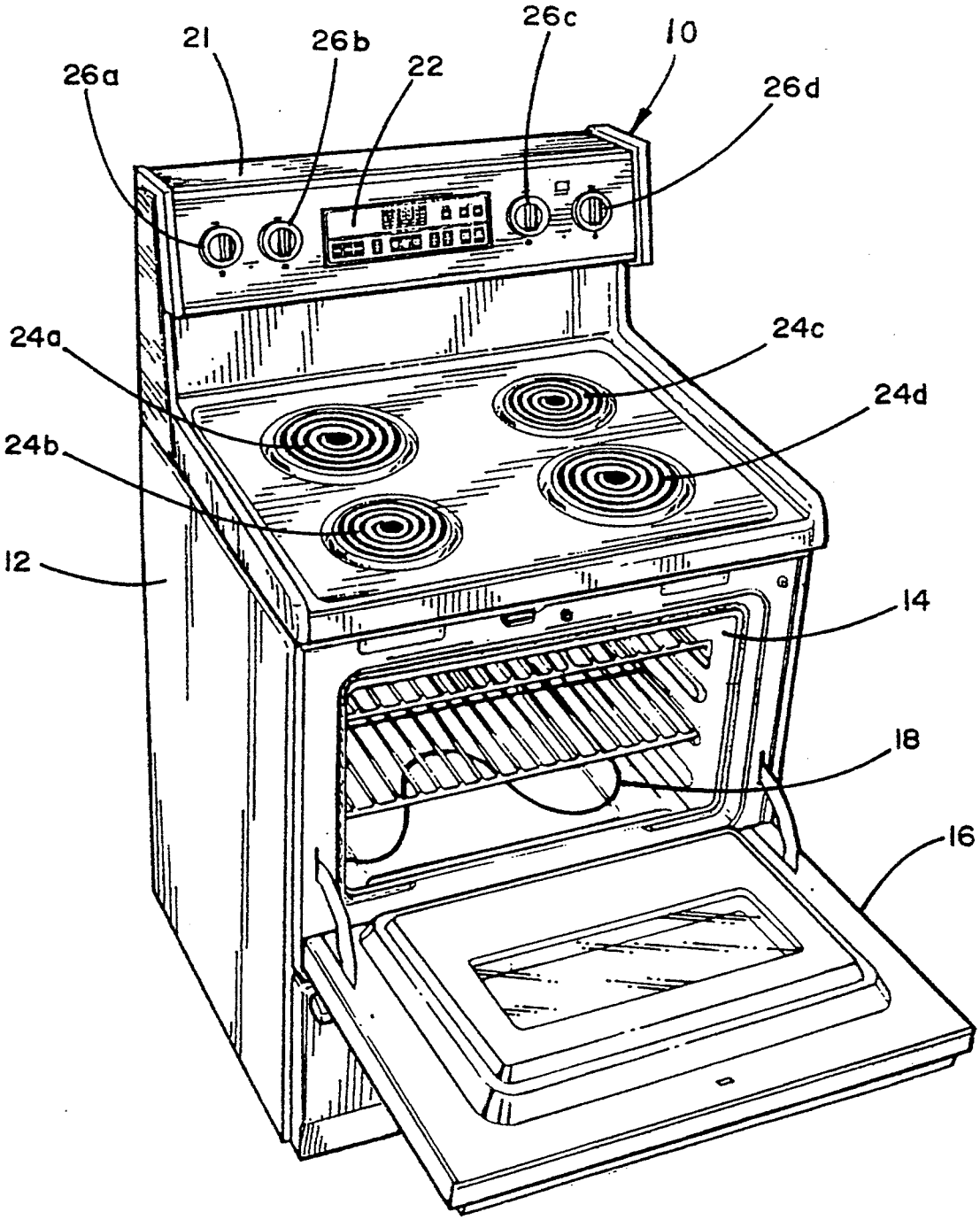
FIG. 1 is a perspective view of a cooking appliance according to the invention.
Figure 4:
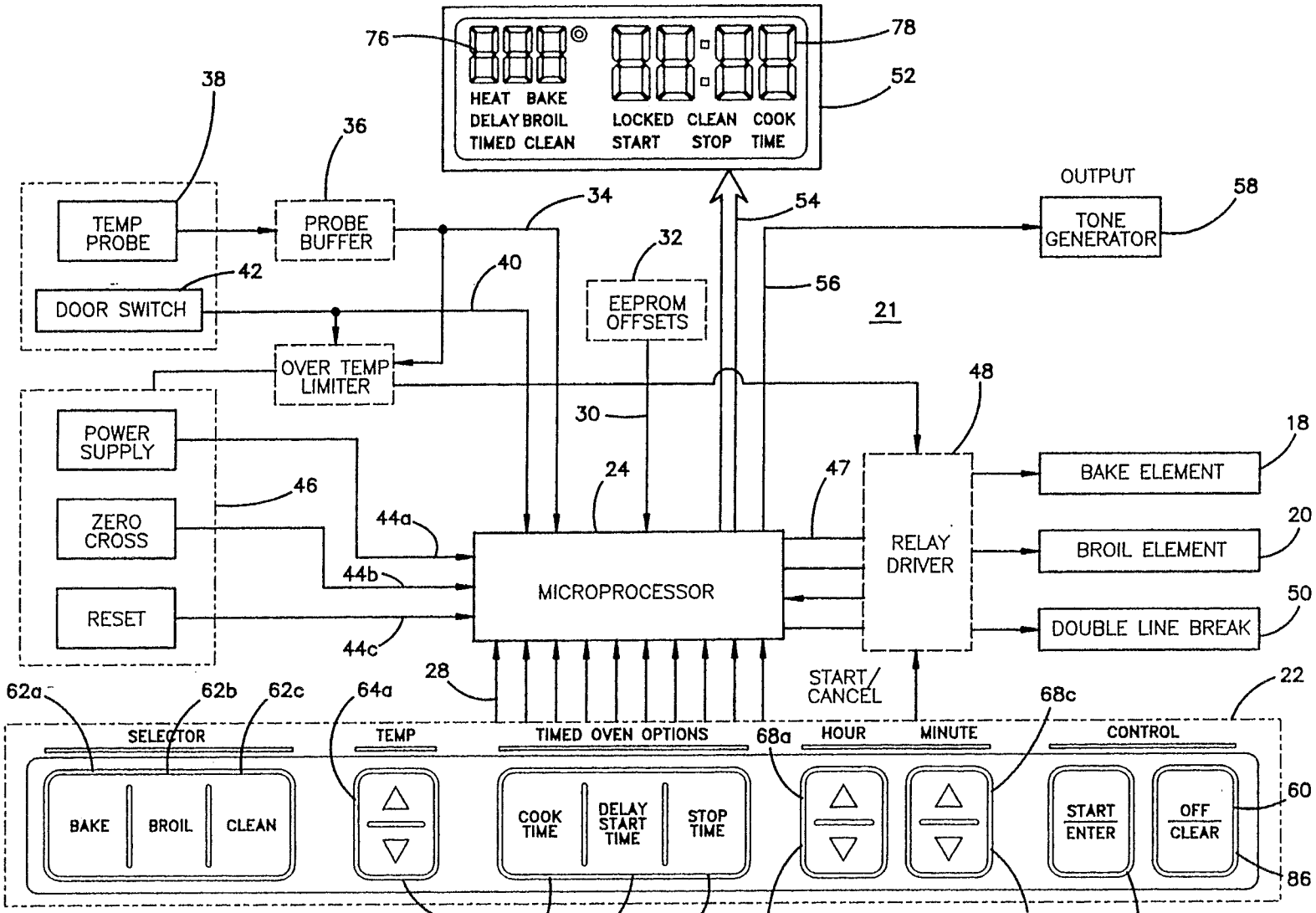
FIG. 4 is a block diagram of the electronic control.

Referring now specifically to the drawings, and the illustrative embodiments depicted therein, a domestic cooking range 10 includes a cabinet 12 defining therein an oven cavity 14 which is selectively closed by an oven door 16 (FIG. 1). An oven heating means, including a bake element 18 and broil element 20, are positioned within oven cavity 14, in order to heat the oven cavity, and is controlled by a control module 21. Control module 21 includes a control panel 22 for receiving user input selections and control logic for processing user input selections and driving output devices, including a logic device, such as microprocessor 24 (FIG. 4). Cooking range 10 may further include a plurality of rangetop cooking elements 24a, 24b, 24c and 24d and corresponding controls 26a, 26b, 26c and 26d for controlling the associated cooking elements 24a–24d independent of the oven heating means.

Microprocessor 24i s provided with inputs on input lines 28 from input control panel 22 in order to receive user input selections (FIG. 4). Microprocessor 24 additionally receives code input on a line 30 from a memory device, such as an EEPROM 32, in order to establish offsets in the microprocessor 24 that are applicable to the particular model of cooking range 10 to which control module 21 is applied. Microprocessor 24 additionally receives inputs on line 34 from a buffer circuit 36 associated with a temperature probe 38 and on a line 40 from a door closure sensing switch 42. Additional inputs are received on lines 44a, 44b and 44c indicating the status of the electrical power supplied to cooking range 10 from a power supply monitor module 46. Microprocessor 24 supplies outputs to a relay driver assembly 48 which, in turn, applies high voltage AC power to bake element 18, broil element 20 and a circuit breaker 50 by driving associated relays. Microprocessor 24.additionally supplies display data to a display element 52 over a data bus 54 and to a line 56 in order to activate a tone generator 58.

Figure 2:
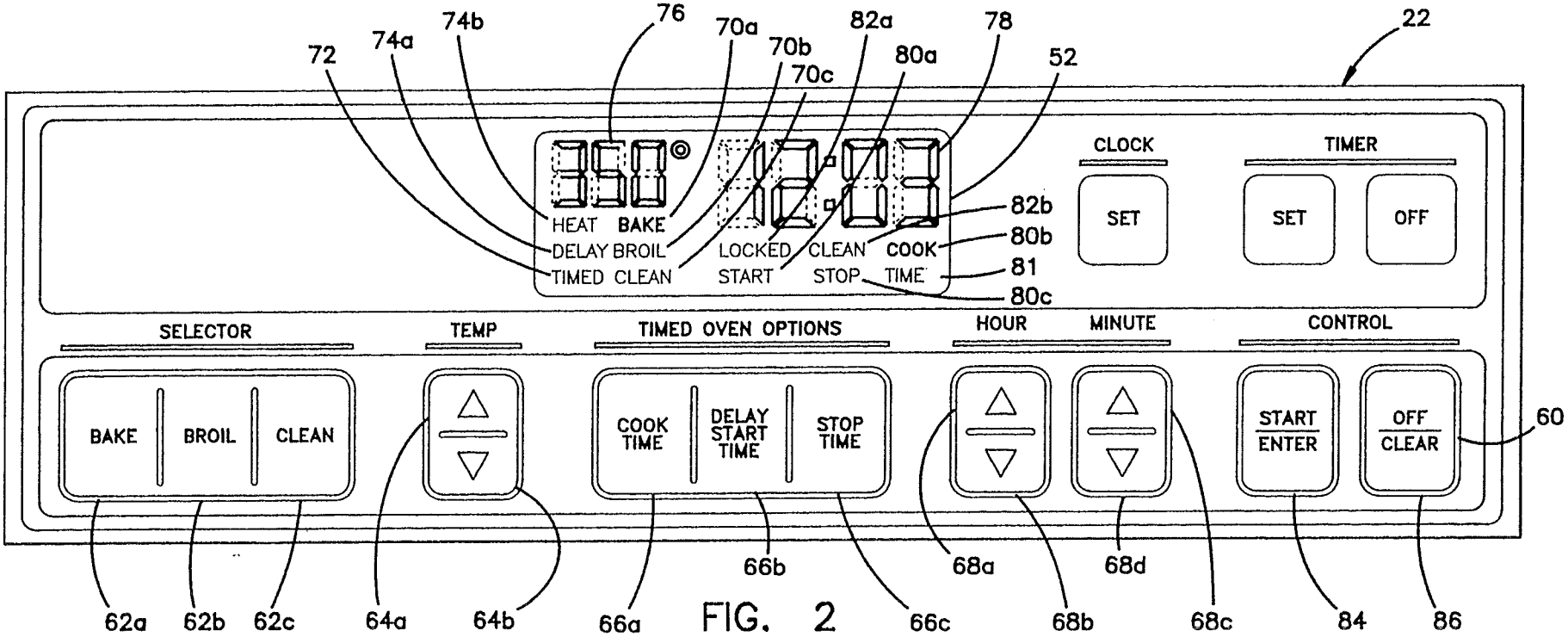
FIG. 2 is a front elevation of an input display panel according to the invention.

Input control panel 22 includes a plurality of input devices, illustrated as touch-responsive mylar switches 60, which supply inputs to microprocessor 24 over input lines 28 (FIGS. 2 and 4). Input devices 60 include heating function input devices 62a, 62b and 62c which select, respectively, the cooking functions of baking (62a) and broiling (62b) and an oven cleaning (62c) function. As is well understood in the art, the baking function is carried out by energizing bake element 18 in order to provide a substantially constant temperature throughout the oven cavity 14 in order to cook throughout food placed in oven cavity 14. The broil function is carried out by actuation of the broil element 20 in order to brown the exterior of foods by direct radiation from broil element 20. The cleaning function reduces residual food adhered to the walls defining oven cavity 14 by pyrolysis resulting from utilizing bake element 18 and broil element 20, together, to raise the temperature of oven cavity 14 to a suitably high temperature. Input devices 60 further include temperature input selection switches 64a and 64b which allow the user to raise (64a) or lower (64b) the set point temperature associated with the heating function selected by input devices 62a–62c.

Input devices 60 additionally include timing function input devices 66a , 66b and 66c for selecting, respectively, a "cook time" function, a "delay start time" function and a "stop time" function. The "cook time" function, invoked by input device 66a, selects a time interval for which the heating function, selected by heating function input devices 62a–62c, is carried out. The "cook time" function may be used alone, or in combination with one of the "delay start time" or "stop time" functions. The "delay start time" function, invoked by input device 66b, allows the user to select a clock time for the selected heating function to start. The "delay start time" function must be used in combination with the selection of a "cook time" or a "stop time" function. The "stop time" function, invoked by actuation of input device 66c, allows the user to select a time at which the selected heating function terminates. The "stop time" function may be used in combination with either the "cook time" function or the "delay start time" function.

Time selection input devices 68a, 68b, 68c and 68d allow the user to increase the hours (68a) and minutes (68c) or decrease the hours (68b) and minutes (68d) associated with the function selected by timing function input devices 66a–66c. The timing functions invoked by actuation of timing input devices 66a–66c may be applied to any one of the "bake," "broil" and "clean" heating functions selected by input devices 62a–62c. The complete selection of a heating function and one or more timing functions establish a time-temperature profile for oven cavity 14, including the particular elements 18, 20 that will be applied to heating the oven.

Display element 52 includes function indicators 70a, 70b and 70c to indicate the heating function selected by input devices 62a–62c. An indicator 72 is illuminated when the user has selected a timed oven function by actuation of one or more input devices 66a–66c. Indicators 74a and 74b indicate the present status of the oven in the time-temperature profile selected by the actuation of input devices 60, namely: "delay" indicator 74a is illuminated when the selected start time of the selected heating function has not arrived and the "heat" indicator (74b) is illuminated when a heating function is being performed. Display element 52 additionally includes a temperature display element 76 which indicates either the set point temperature or the actual temperature of oven cavity 14. Display element 52 additionally includes a time display 78 in order to indicate one of a reminder timer function, the present clock time, or a time value associated with the timed oven options selected by input devices 66a–66c. A set of indicators 80a, 80b and 80c indicate, in combination with a "time" indicator 81, the timing function associated with the time being displayed on time display 78. An indicator 82a indicates that a latch (not shown) for oven door 16 has been set by the user as a prerequisite of carrying out the "clean" function. Indicator 82b indicates that a "clean" function is being carried out.

Input control panel 22 additionally includes a "start-/enter" input device 84 and an "off/clear" input device 86. The "start/enter" input device 84 is actuated by the user when the desired heating function has been selected, using input devices 62a–62c, and the desired timing functions have been selected using input devices 66a–66c. Actuation of "start/enter" input device 84 begins control of the temperature of the oven cavity 14 according to the time and temperature profile inputted by the user. The "start/enter" input device 84 may additionally be used by the user to set the timer, clock and other ancillary functions of control module 21, although these ancillary functions may be controlled by other input switch actuations. The "off/clear" device 86 is actuated by the user to terminate the heating of the oven cavity, according to the selected heating profile, and to cancel any selected heating profile.

Figure 5A:
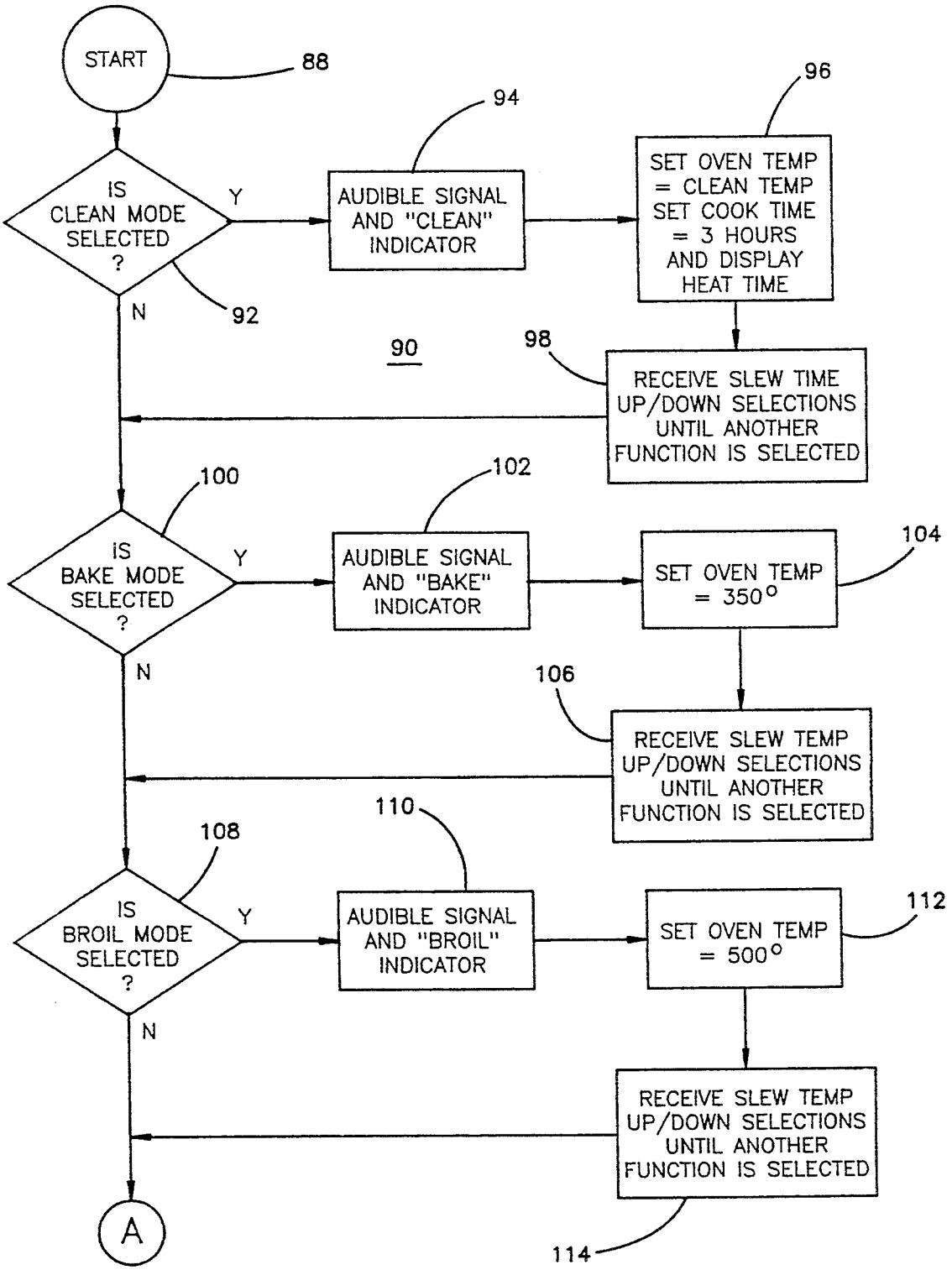
FIG. 5*a*–5*c* is a flowchart of a user input selection program.
Figure 5B:
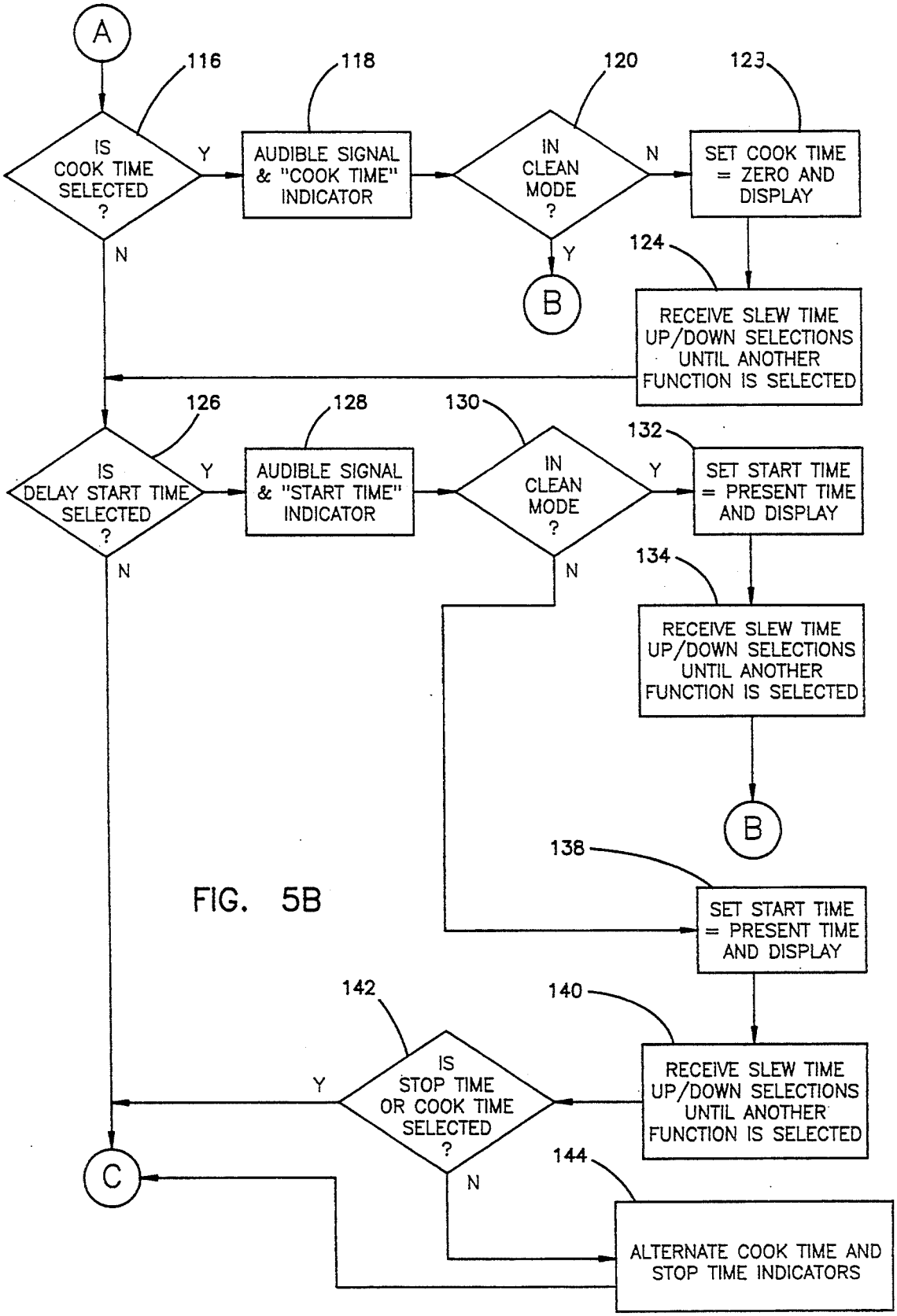
Figure 5C:
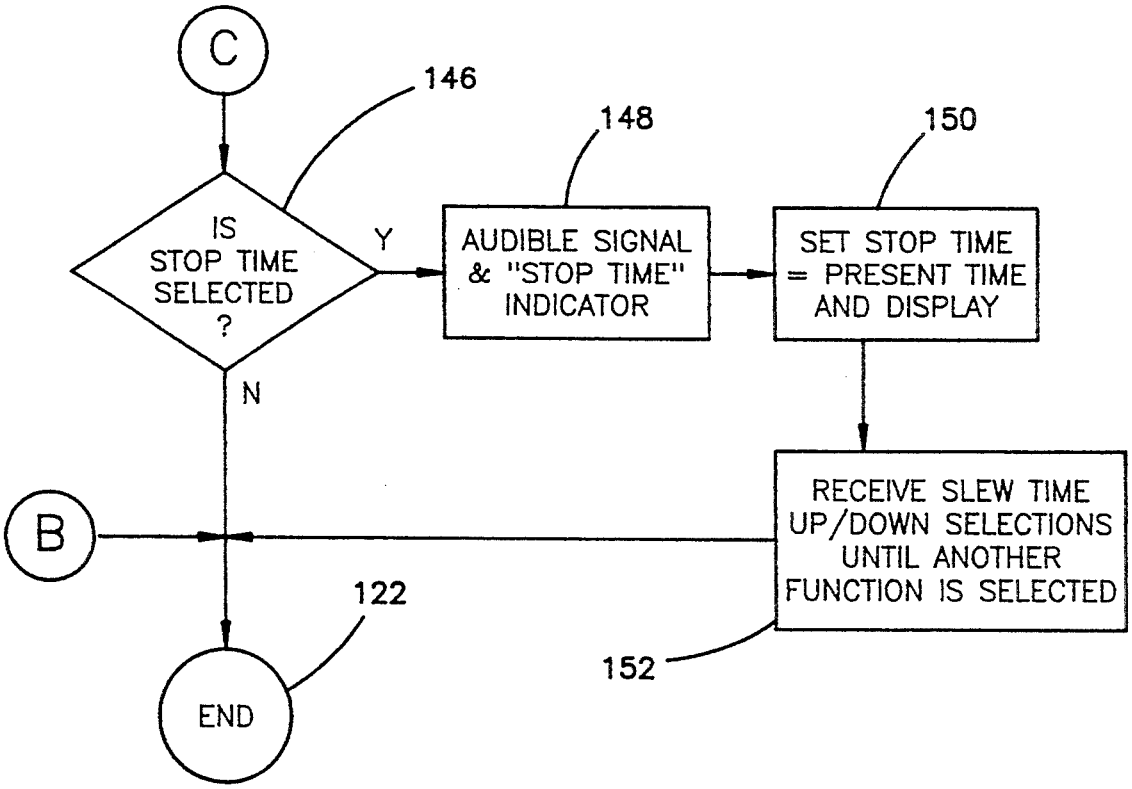

An input control program 90 controls the receipt of user input selections (FIGS. 5a–5c). At the start 88 of each pass through input control program 90, it is determined at 92 whether the user is invoking the "clean" heating mode, or function, by actuating input device 62c. If so, any previously selected heating modes are cancelled, an audible signal is given by tone generator 58 and indicator 70c is illuminated at 94. A default oven temperature, appropriate for the pyrolytic cleaning function, is set for the "oven temp" parameter. Unless the user has already selected a "cook time" parameter, or if the user has selected a "cook time" parameter that is too high or too low for the oven cleaning function, a default time value, such as three hours, is set for the "cook time" parameter at 96. The default time and temperature values are displayed, respectively, on time display 78 and temperature display 76. The program then cycles through a control loop at 98 during which user selections of time change commands, via input devices 68*a*–68*d*, are received and carried out. The program routine at 98 is exited when the user selects another function, such as a timed oven function, or actuates the "start/enter" or "off/clear" commands.

If it is determined at 92 that the "clean mode" is not being selected, it is then determined at 100 whether the user is selecting the "bake" mode by actuating input device 62*a*. If so, any previously selected heating modes are cancelled, an audible signal is generated by tone generator 58 and the bake indicator 70*a* is illuminated at 102. A preset default temperature value is assigned to the "oven temp" parameter at 104 and user changes to the preset default temperature value are received at 106 until another function is selected.

If it is determined at 100 that the "bake" mode is not being selected, then it is determined at 108 whether the "broil" mode is being selected by the user actuating input device 62*b*. If so, then any previously selected heating modes are cancelled, tone generator 58 gives an audible signal and indicator 70*b* is illuminated at 110. A preset default temperature value is then assigned to the "oven temp" parameter at 112 and user changes to the "oven temp" parameter are received at 114 until another function is selected.

If it is determined at 108 that the broiling mode is not being selected, then it is determined at 116 whether the user is selecting the "cook time" function by actuating input device 66*a*. If so, an audio signal is generated by tone generator 58 and indicators 80*b* and 81 are illuminated at 118. It is then determined at 120 whether the oven is in a "clean" mode. If so, the program is exited at 122. Alternatively, control could be directed to block 96 in order to receive user input selections increasing and decreasing the value of "cook time" for the clean mode. If it is determined at 120 that the oven is not in a "clean" mode, then the "cook time" parameter is set to zero and displayed on time display 78 at 123. User input selections increasing and decreasing the time set at display 78 are received at 124, until another function is selected.

If it is determined at 116 that the "cook time" function is not being selected, then it is determined at 126 whether the user is selecting the "delay start time" function by actuating input device 66*b*. If so, an audio signal is generated by tone generator 58 and indicators 80*a* and 81 are illuminated at 128. It is then determined at 130 whether the oven is in a "clean" mode. If so, the "start time" parameter is preset to the present clock time and displayed on time display 78 at 132. User input selections increasing and decreasing the value of the "start time" are received at 134 until another function is selected. The program is then exited at 122. If it is determined at 130 that the control is not in a "clean" mode, then the "start time" parameter is preset with the present clock time at 138 and displayed on time display 78. User input selections increasing or decreasing the preset "start time" parameter are received at 140 until another function is selected. It is then determined at 142 whether the "stop time" or "cook time" functions have been invoked by the user. If not, the "cook time" indicators 80*b* and 81 and "stop time" indicators 80*c* and 81 are alternately illuminated at 144 until the user selects a "cook time" or "stop time" function.

If it is determined at 126 that the user is not selecting the "delay start time" function, it is determined at 146 whether the user is selecting the "stop time" function by actuating input device 66*c*. If so, an audible signal is generated by tone generator 58 and indicators 80*c* and 81 are illuminated at 148. The "stop time" parameter is preset with the present clock time, or the preset "start time" parameter if one has been selected, and displayed on time display 78 at 150. User selections to increase or decrease the "stop time" parameter are received at 152 until another function is selected. The program is then exited at 122.

The input control routine 90 is cyclically followed so that a particular function may be selected during one pass through the program and another function selected during a subsequent pass through the program. The timing functions may be selected prior to selecting the heating functions or vice versa. When the user is satisfied with the heating function and associated value of the temperature set point parameter, as well as any timing function that may have been selected, the user actuates the "enter/start" input device 84 which invokes at 154 a cooking control routine during which the oven is heated according to the selected time and temperature parameters, as is conventional. However, in a preferred embodiment, the program prompts the user to select a heating function if the "enter/start" input device is actuated with only timing parameters having been selected.

With the above-described oven control 21, the user can adjust the temperature and/or time parameters even after the "start/enter" input device 84 is actuated to initiate the time and temperature heating profile of the oven. For example, if the user desires to increase or decrease the bake or broil temperature, the user need only actuate the associated input device 62*a* or 62*b* and adjust the temperature value displayed on temperature display 76, using temperature selection devices 64*a* and/or 64*b*. Similarly, if the user wishes to adjust the "cook time" duration, the user actuates the "cook time" input device 66*a*, which will display the selected "cook time" on time display 78. The user may then adjust the "cook time" interval with the input devices 68*a*–68*d*. At any time during the programming or oven heating functions, actuation of the "off/clear" input device 86 terminates the heating operation and clears any functions and parameter values previously selected by the user.

Figure 3:
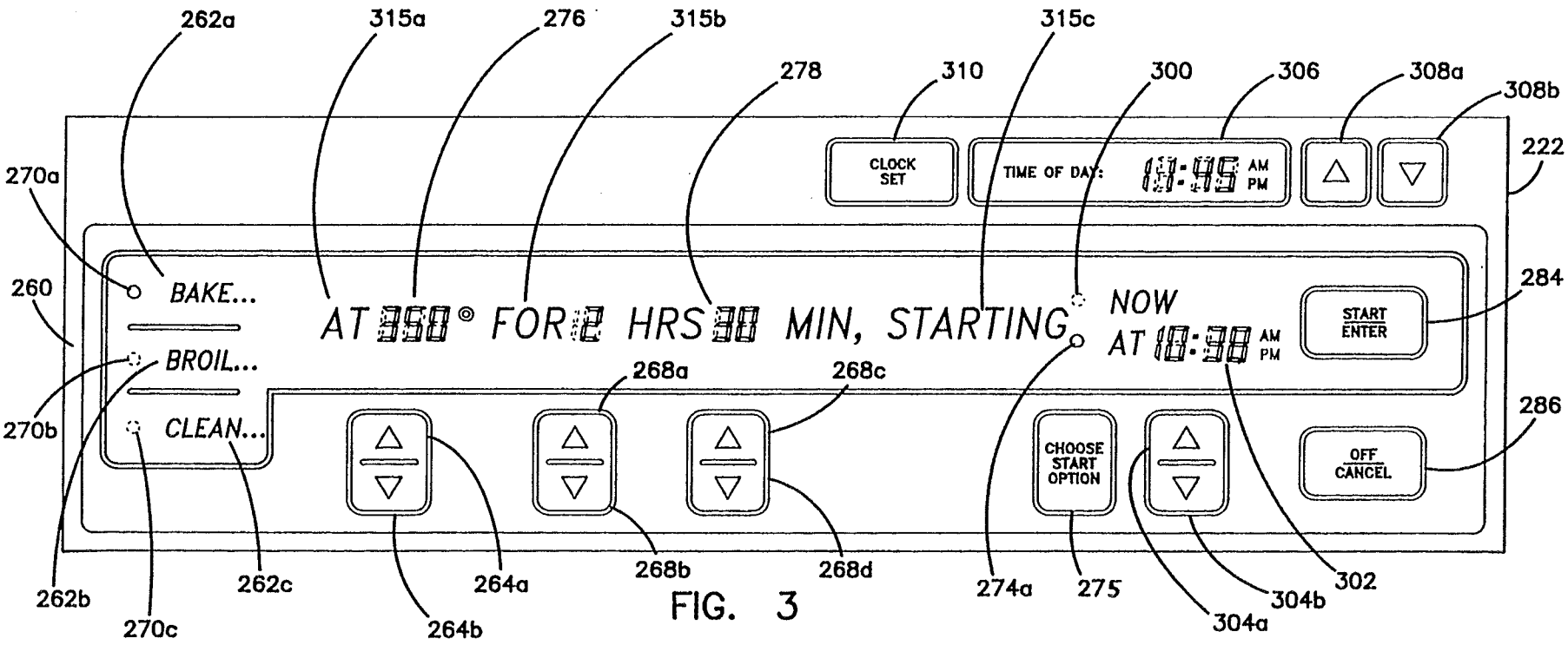
FIG. 3 is the same view as FIG. 2 of an alternative embodiment of the invention; control.

An alternative embodiment of an input control panel 222 includes a plurality of input devices 260 which are organized in combination with display elements and indicia in a particular manner. The oven functions and parameters are addressed substantially independently as components of a sentence. In reference to FIG. 3, input control panel 222 includes heating function input devices 262*a*, 262*b* and 262*c* for selecting, respectively, the baking, the broiling and the cleaning heating functions. Indicators 270*a*, 270*b* and 270*c* provide, respectively, indications that the baking, broiling or cleaning function has been selected. Temperature input selection devices 264*a* and 264*b* receive user input commands to increase or decrease an "oven temp" parameter which is displayed on a temperature display 276. Time input devices 268*a*, 268*b*, 268*c* and 268*d* receive user input selection to increase and decrease the hours and minutes associated with a "cook time" function, the selected time being displayed on a time display 278. A delay start option input device 275 allows the user to select between an immediate initiation of the heating function, as indicated by an indicator 300, and a "delay start" function, as indicated by an indicator 274*a*. A display 302 associated with the "delay start" function displays the "start time" parameter. Input devices 304*a* and 304*b* receive user selections to increase or decrease the "start time" displayed on display 302. A "start/enter" input device 284 and an "off/cancel" input device 286 perform substantially the same function as devices 84 and 86 in the previously described embodiment. A time-of-day display 306 displays the "present time" parameter and is adjustable by user operable input devices 308*a* and 308*b* upon actuation of a "clock set" mode select input device 310.

Input control panel 222 additionally includes prompting indicia 315*a*, 315*b* and 315*c*. These indicia provide the necessary grammatical prepositions for modifying the grammatical verbs "bake, " "broil" and "clean, " which define the respective heating functions. The displays 276, 278 and 302 establish objects for the respective prepositions. The input devices, displays and prompting indicia are laid out in a linear fashion, with the sentence reading from left-to-right laterally across the face of control panel 222, which is the direction the eye scans in order to read. However, other arrangements of the sentence elements, including non-English language grammatical structures, will be apparent to those skilled in the art. In addition, the prompting indicia could be provided via a display device or similar means.

The use of such sentence programming provides an intuitive input device which prompts the user to select input functions and parameters. In the illustrated embodiment, a clear, continuous display of the appropriate information is provided for review at any time during the input selection operation. Such sentence programming, in a preferred form, is intended to emulate the statement at the end of conventional recipes. The heating functions and timing functions selected by such sentence programming are, in essence, the same as those previously described. Additional functions may be added to the sentence structure illustrated in FIG. 3. For example, a "stop time" function may be added at the end of the illustrated sentence. This may be accomplished by adding indicia for the preposition "stopping at," followed by a suitable time display and a "stop time" user input device (not shown).

Thus, it is seen that the present invention provides an exceptionally flexible, yet clear and concise, input device for a cooking range. By allowing the user to combine any of the "cook time," "start time" and "stop time" timing functions with any of the "bake," "broil" and "clean" heating functions, the full potential of an electronic control for a cooking oven may be realized. By arranging the input selection devices for various functions and parameters with indicators and prompting indicia arranged in a grammatical sentence, the input function may be carried out intuitively without reference to a user's manual. Although the invention has been illustrated with respect to a cooking oven that is part of a freestanding range, its principles are applicable to separate built-in ovens and other appliance combinations. Additionally, the invention may be applied to natural gas or propane heated ovens, as well as the illustrated all-electric oven.

Changes and modifications in these specifically described embodiments can be carried out without departing from the principles of the invention, which is intended to be limited only by the scope of the appended claims, as interpreted according to the principles of patent law, including the Doctrine of Equivalents.

The embodiments of the invention in which an exclusive property or privilege is claimed are defined as follows:

1. A cooking oven having means defining an oven cavity, heating means for heating said oven cavity to defined heating temperatures and a control means for receiving user input selections and for establishing a time and temperature heating profile of said oven cavity and for controlling said heating means according to said heating profile, said control means comprising:

input selection means for receiving user input selections;

logic means responsive to said input means for establishing a time and temperature heating profile of said oven and for controlling said heating means according to said heating profile; and said input selection means including heating function selection means for receiving a user selection of a heating function from among a plurality of heating functions and timing function selection means for receiving user selection of at least one timing function from among a plurality of timing functions, .wherein said heating functions include a function for cooking of food in said oven cavity and a cleaning function for pyrolytic cleaning of said oven cavity, wherein said heating function selection means is substantially independent of said timing function selection means so that a user may select substantially any one of said timing functions with any one of said heating functions.

2. The cooking oven of claim 1 wherein said input selection means includes means responsive to said heating function selection means for prompting a user to select values of particular heating parameters for particular ones of said plurality of heating functions and means for receiving user selection of values of said particular heating parameters.

3. The cooking oven of claim 2 wherein said input selection means includes means responsive to said timing function selection means for prompting a user to select values of particular timing parameters for particular ones of said plurality of timing functions and means for receiving user selection of values of said particular timing parameters.

4. The cooking oven of claim 1 wherein said input selection means includes means responsive to said timing function selection means for prompting a user to select values of particular timing parameters for particular ones of said plurality of timing functions and means for receiving user selection of values of said particular timing parameters.

5. The cooking oven of claim 1 wherein said cooking of food function includes a broiling function and a baking function.

6. The cooking oven of claim 1 wherein said timing functions include selectable start time of the selected heating function, selectable stop time of the selected heating function and selectable time duration of the selected heating function.

7. The cooking oven of claim 1 wherein said timing functions include selectable start time of the selected heating function, selectable stop time of the selected heating function and selectable time duration of the selected heating function.

8. A cooking oven having means defining an oven cavity, heating means for heating said oven cavity to defined heating temperatures and a control means for receiving user input selections and for establishing a time and temperature heating profile of said oven cavity and for controlling said heating means according to said heating profile, said control means comprising:

input selection means for receiving user input selections including heating mode selection means for receiving a user selection of a heating mode, temperature entry means for entering a heating temperature for said oven cavity, time mode selection means for receiving user selections of at least one timing mode independently of the selected heating mode, time entry means for entering a time value for each selected timing mode, a temperature display for displaying a selected value of said heating temperature and at least one time display for displaying a selected value for said entered time value;

logic means responsive to said heating mode selection means, said temperature entry means, said time mode selection means and said time entry means for establishing a time-temperature profile for said oven cavity, said logic means including means for determining times for actuating and deactuating said heating means and means controlling said heating means in order to establish said heating temperature in said oven cavity according to the established time-temperature profile; and start input means for receiving a user indication that input selection is complete, where in said logic means repetitively reviews the actuation condition of each of said selection means to thereby respond to actuation of said selection means in any sequence prior to actuation of said start means and repetitively updates said temperature display and said at least one time display with selected values prior to actuation of said start input means and wherein said logic means is responsive to actuation of said start input means in order to control said heating means according to said time-temperature profile.

9. The cooking oven in claim 8 wherein said user selection of a heating mode is from one of a cooking mode and a cleaning mode.

10. The cooking oven of claim 9 wherein said cooking mode includes a broiling mode and a baking mode.

11. The cooking oven in claim 8, wherein said at least one timing mode is selected from at least one of a selected heating time interval, a selected start time and a selected stop time.

12. A cooking oven having means defining an oven cavity, heating means for heating said oven cavity to defined heating temperatures and a control means for receiving user input selections and for establishing a time and temperature heating profile of said oven cavity and for controlling said heating means according to said heating profile, said control means comprising:

input selection means for receiving user input selections;

logic means responsive to said input means for establishing a time and temperature heating profile of said oven and for controlling said heating means according to said heating profile; and said input selection means including a panel and selection means on said panel for receiving user input selections of a heating function, heating parameters, timing function and timing parameters, said selection means including parameter display devices positioned on said panel each for displaying a selected value of one of said parameters, selection devices for selecting parameter values for said parameter display devices, parameter indicia on said panel adjacent said display device for identifying which of said parameters is displayed on the display devices and modifying indicia on said panel adjacent said parameter indicia for providing grammatical modification to the parameter indicia, wherein said modifying indicia and said parameter indicia read as a grammatical sentence format.

13. The cooking oven of claim 12 wherein said modifying indicia, said parameter display devices and said parameter indicia are linearly arranged on said panel.

14. The cooking oven of claim 13 wherein said modifying indicia, said parameter display devices and said parameter indicia extend across said panel laterally from left-to-right as viewed by a user.

15. The cooking oven of claim 13 wherein said selection means include printed indicia on said panel to define labels for said labeled selection devices and said labeled parameter display devices.

16. The cooking oven of claim 12 including a function display device for displaying a user selection of a heating function, a function selection device for receiving a user selection of a heating function and a function indicia adjacent said function display device for identifying the heating function, wherein said function indicia is included in said grammatical sentence format.

17. The cooking oven of claim 12 wherein said grammatical sentence corresponds with cooking recipe instructions.

18. The cooking oven of claim 17 wherein said selection devices include a heating mode selection device for receiving a user selection of a heating mode from one of a cooking mode and a cleaning mode, a temperature entry device for entering a heating temperature for said oven cavity, a time mode selection device for receiving user selections of at least one timing mode independently of the selected heating mode wherein any of said timing modes may be selected with any one of said heating functions, and a time entry device for entering time values for the selected timing modes.

19. The cooking oven of claim 18 wherein said timing modes include selected heating time intervals and a selected start time.

20. The cooking oven of claim 12 wherein said selection devices include a heating mode selection device for receiving a user selection of a heating mode from one of a cooking mode and a cleaning mode, a temperature entry device for entering a heating temperature for said oven cavity, a time mode selection device for receiving user selections of at least one timing mode independently of the selected heating mode wherein any of said timing modes may be selected with any one of said heating functions, and a time entry device for entering time values for the selected timing modes.

21. The cooking oven of claim 20 wherein said timing modes include selected heating time intervals and a selected start time.

22. A cooking oven having means defining an oven cavity, heating means for heating said oven cavity to defined heating temperatures and a control means for receiving user input selections and for establishing a time and temperature heating profile of said oven cavity and for controlling said heating means according to said heating profile, said control means comprising:

input selection means for receiving user input selections including a heating mode selection device for receiving a user selection of a heating mode from one of a cooking mode and a cleaning mode, a temperature entry device for entering a heating temperature parameter for said oven cavity, a temperature parameter display device for displaying the entered temperature parameter, a time mode selection device for receiving user selections of at least one timing mode independently of the selected heating mode, a time parameter entry device for entering time values for the selected timing mode and a time parameter display device for displaying the entered time parameter value;

logic means responsive to said heating mode selection device, said temperature entry device, said time mode selection device and said time entry device for establishing a time-temperature profile for said oven cavity, said logic means including means for determining times for actuating and deactuating said heating means and means controlling said heating means in order to establish said heating temperature in said oven cavity according to the established time-temperature profile; and a panel for mounting said input selection devices and parameter display devices including prompting indicia on said panel adjacent said selection devices and said parameter display devices, said prompting indicia identifying the purpose of each said selection devices and display devices and including modifying indicia on said panel for providing grammatical modification to said prompting indicia, wherein said modifying indicia and said parameter indicia read as a grammatical sentence format.

23. The cooking oven of claim 22 wherein said modifying indicia, said parameter display devices and said prompting indicia are linearly arranged on said panel,

24. The cooking oven of claim 22 wherein said modifying indicia, said parameter display devices and said prompting indicia extend across said panel laterally from left-to-right as viewed by a user.

25. The cooking oven of claim 22 wherein said prompting indicia include printed indicia applied to said panel.

26. The cooking oven of claim 22 wherein a portion of said prompting indicia associated with said heating mode selection means is a grammatical verb and the portions of said prompting indicia associated with said parameter display devices are grammatical prepositions whereby parameters displayed by said parameter display devices are grammatical objects of said prepositions.

27. The cooking oven of claim 22 wherein said grammatical sentence portion corresponds with cooking recipe instructions.

28. A method for controlling a cooking oven having means defining an oven cavity and heating means for heating said oven cavity to defined heating temperatures, including the steps of:

receiving a user heating function selection from among a plurality of heating functions and up to two timing functions selected from among a plurality of timing functions independently of the timing function selected, whereby a user may select substantially any combination of timing functions with any selected heating function;

establishing a time and temperature heating profile of said oven cavity from the selected heating and timing functions; and controlling said heating means according to said heating profile.

29. The method in claim 28 including prompting a user to enter values of particular heating parameters for particular ones of said plurality of heating functions and receiving user entry of values of said particular heating parameters.

30. The method in claim 29 including prompting a user to enter values of particular timing parameters for particular ones of said plurality of timing functions and receiving user entry of values of said particular timing parameters.

31. The method in claim 28 including prompting a user to enter values of particular timing parameters for particular ones of said plurality of timing functions and receiving user entry of values of said particular timing parameters.

32. The method in claim 28 wherein said heating functions include cooking of food in said oven cavity and pyrolytic cleaning of said oven cavity.

33. The method in claim 32 wherein said cooking of food includes broiling and baking of said food.

34. The method in claim 33 wherein said timing functions include delaying start of the selected heating function, establishing a stop time of the selected heating function and establishing a time duration of the selected heating function.

35. The method in claim 28 wherein said timing functions include delaying start of the selected heating function, establishing a stop time of the selected heating function and establishing a time duration of the selected heating function.

36. A method for controlling a cooking oven having means defining an oven cavity, heating means for heating said oven cavity to defined heating temperatures, including the steps of:

prompting a user input selection of a heating mode from one of a cooking mode and a cleaning mode;

prompting a user input entry of a heating temperature for said oven cavity and displaying the entered heating temperature;

prompting a user selection of up to two timing modes independently of the selected heating mode;

prompting a user entry of time values for the selected timing modes and displaying the entered time values;

wherein said prompting and said displaying steps define at least a portion of a grammatical sentence to the user;

establishing a time and temperature heating profile of said oven cavity from the selected heating function and timing functions and entered heating temperature and time values; and controlling said heating means according to said heating profile.

37. The method in claim 36 wherein said grammatical sentence portion corresponds with cooking recipe instructions.

38. The method in claim 36 wherein said cooking mode includes one of broiling food and baking food.

39. The method in claim 38 wherein said timing modes include delaying start of the selected heating function, establishing a stop time of the selected heating function and establishing a time duration of the selected heating function.

40. The method in claim 36 wherein said timing modes include delaying start of the selected heating function, establishing a stop time of the selected heating function and establishing a time duration of the s,elected heating function.

41. The method in claim 36 including prompting user input selection of a heating mode using a grammatical verb, and prompting user entry of temperature and time values using grammatical prepositions whereby said displaying of said temperature and time values provides a grammatical object for said prepositions.

42. The cooking oven of claim 16 wherein said function indicia is a grammatical verb and said modifying indicia are grammatical prepositions.

43. The cooking oven of claim 42 wherein said parameter indicia are grammatical objects of said prepositions.

* * * * *

UNITED STATES PATENT AND TRADEMARK OFFICE

CERTIFICATE OF CORRECTION

PATENT NO. : 5,438,180
DATED : August 1, 1995
INVENTOR(S) : Gerald A.Eisenbrandt, et al It is certified that error appears in the above-indentified patent and that said Letters Patent is hereby corrected as shown below:

Column 2, Line 48
After "invention;" delete --control; and--.

Column 3, Line 5
"24i s" should be --24 is--.

Column 3, Line 22
After "24" delete --.--.

Column 8, line 29
Before "wherein" delete --.--.

UNITED STATES PATENT AND TRADEMARK OFFICE

CERTIFICATE OF CORRECTION

PATENT NO. : 5,438,180
DATED : August 1, 1995
INVENTOR(S) : Gerald A. Eisenbrandt, et al It is certified that error appears in the above-indentified patent and that said Letters Patent is hereby corrected as shown below:

Column 10, Line 7, Claim 12
"device" should be --devices--.

Column 11, Line 39, Claim 23
"panel," should be --panel.--.

Column 11, Line 40, Claim 24
"claim 22" should be --claim 23--.

Column 13, Line 4, Claim 40
"s,elected" should be --selected--.

Signed and Sealed this

Twenty-first Day of November, 1995

Bruce Lehman

*Attest:*

BRUCE LEHMAN

*Attesting Officer*

*Commissioner of Patents and Trademarks*